United States Patent [19]

Grossman

[11] 4,351,080

[45] Sep. 28, 1982

[54] TOOTHBRUSH WITH CURVED BRISTLES AND HANDLE

[76] Inventor: Milton Grossman, 206 Channel Dr., Monmouth Beach, N.J. 07750

[21] Appl. No.: 163,987

[22] Filed: Jun. 30, 1980

[51] Int. Cl.[3] ..... A46B 9/04

[52] U.S. Cl. ..... 15/167 R; 15/143 R

[58] Field of Search ..... 15/167 R, 167 A, 143 R, 15/110, 160; D4/10–31

[56] References Cited

U.S. PATENT DOCUMENTS

D. 118,073 12/1939 Gower ..... 15/143 R
D. 139,264 10/1944 Littig ..... D4/28
D. 210,348 3/1968 Levin ..... D4/31
2,056,447 10/1936 Fell ..... 15/167 R
4,010,509 3/1977 Huish ..... 15/110

FOREIGN PATENT DOCUMENTS 17666 of 1896 United Kingdom ..... 15/167 R
490892 8/1938 United Kingdom ..... 15/167 R

*Primary Examiner*—Peter Feldman
*Attorney, Agent, or Firm*—Donald R. Heiner

[57] ABSTRACT

A toothbrush having a bristle head and handle wherein the bristle rows are curved from front to back and wherein the handle is both bowed and also curved in a direction opposite to the curve of the bristles enabling the brush head bristles to make direct contact with the teeth and gum lines simultaneously.

4 Claims, 5 Drawing Figures

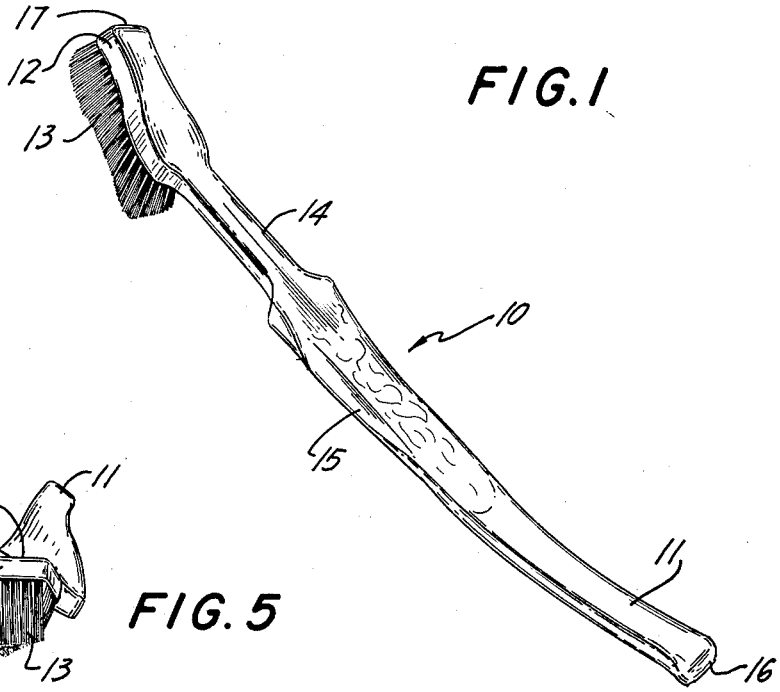
FIG. 1
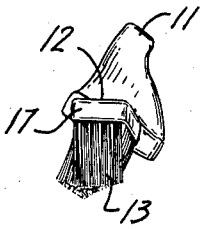
FIG. 5
FIG. 2
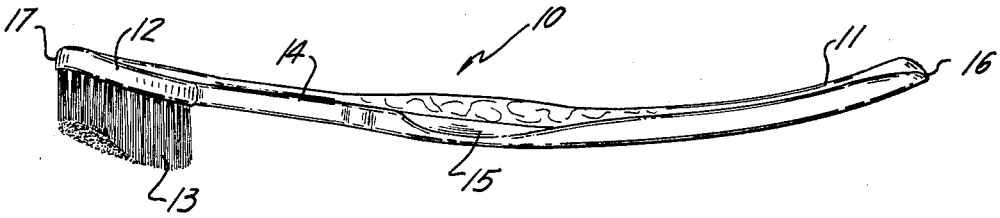
FIG. 3
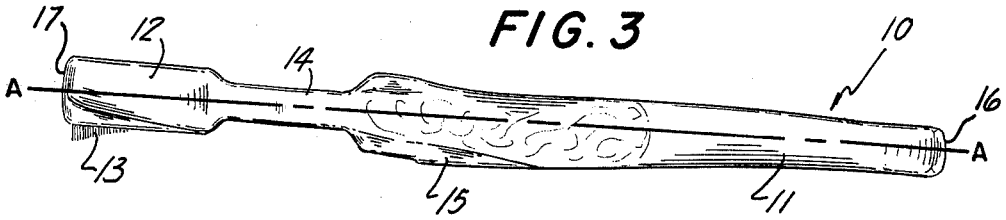
FIG. 4
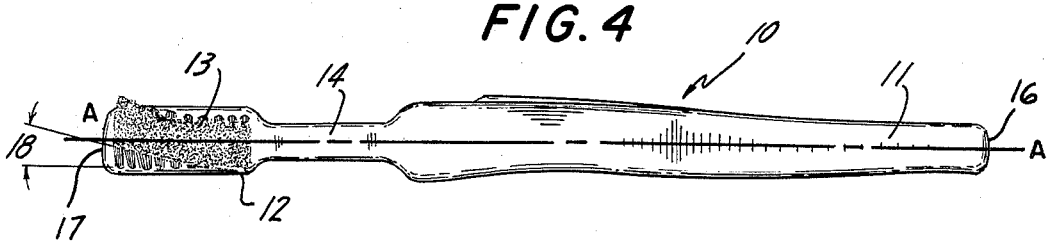

TOOTHBRUSH WITH CURVED BRISTLES AND HANDLE

BACKGROUND OF THE INVENTION

The present invention relates generally to the field of dental hygiene and more particulary to the field of toothbrushes wherein a toothbrush having a curved bristle head and a curved and bowed handle is disclosed which allows the user to make simultaneous contact with the teeth and gum lines without the necessity of twisting the hand or wrist.

The brush comprises a bristle head portion and a handle portion wherein the rows of bristles are slightly curved from front to rear along the longitudinal axis of the toothbrush and the handle portion is curved or twisted in a direction opposite to the curve of the bristles along the same longitudinal axis. Further, the handle is curved in a blow like manner thereby enabling the bristles of the brush head to make direct contact with the teeth.

Toothbrushes currently in use generally do not show the combination of curved bristle heads, curved or twisted handles and a bow to the handle allowing simultaneous contact of the teeth and gum lines without the necessity of the user twisting a hand or wrist.

SUMMARY OF THE INVENTION

Briefly, the invention relates to a toothbrush designed to allow the user, without rotating his or her hand or wrist, to make contact with the teeth surfaces and the gum lines simultaneously and automatically.

The toothbrush essentially comprises a brush head having bristles extending upwardly therefrom and a handle extending from the brush head with the head and handle preferably formed in one piece.

The bristles of the brush head are curved away from a longitudinal axis through the handle and brush head and in the same horizontal plane, in a smooth continuous fashion with the bristles near the front of the toothbrush, distant from the handle end, displaced a greater distance then the bristles near the back end of the toothbrush near the handle.

The handle of the toothbrush is twisted slightly about its longitudinal axis essentially in the opposite direction of the curve of the bristles and into the horizontal plane.

The handle is also bowed with the end furthest away from the bristle head arched downwardly.

The user grasps the handle in the usual manner and due to the curve of the brush head, the twisting of the handle, and the bowing of the handle, the bristles will automatically and simultaneously contact the surface of the teeth and the gum line upon brushing without the necessity of twisting or turning the hand or wrist.

Accordingly, it is an object of the invention to provide a novel toothbrush.

Another object of the invention is to provide a novel toothbrush wherein the brush head contains rows of bristles which are curved away from the longitudinal axis of the toothbrush but in the same horizontal plane.

Another object of the invention is to provide a novel toothbrush wherein the handle is twisted slightly about its longitudinal axis in the generally opposite direction of the curve of the bristles and into the horizontal plane.

Another object of the invention is to provide a novel toothbrush wherein the handle is bowed.

Another object of the invention is to provide a novel toothbrush wherein the user grasps the handle in the usual manner and due to the curve of the brush head, the twisting of the handle, and the bowing of the handle, the bristles will automatically and simultaneously contact the surface of the teeth and the gum line upon brushing without the necessity of twisting or turning the hand or wrist.

These and other objects and advantages of the invention are believed made clear by the following description thereof taken in conjunction with the accompanying drawings wherein:

IN THE DRAWINGS

FIG. 1 is a perspective view of the toothbrush essentially from the bottom thereof;

FIG. 2 is a side view;

FIG. 3 is a bottom view;

FIG. 4 is a top view; and,

FIG. 5 is an end view looking into the bristle head end.

DESCRIPTION OF THE PREFERRED EMBODIMENT

The toothbrush 10 comprises a handle 11 and brush head 12 having a plurality of bristles 13 extending vertically upward therefrom and embedded in the brush head in the usual manner. The brush head 12 and handle 11 are preferably formed as one piece from plastic or any other suitable material.

The handle 11, beginning at neck 14, and rearward therefrom, toward the end of the handle, is twisted about a longitudinal axis through the handle and brush head. The direction of the twist is to the left and into the plane of the drawing when viewing FIG. 4 of the drawing, as shown by the arrow in FIG. 4, for a right handed toothbrush and to the right and into the plane of the drawing for a left handed toothbrush for reasons to be more fully described below in reference to the brush head.

The handle 11 will have a natural thumb depression 15 due to the twisting of the handle which depression will allow a more comfortable grip.

Handle 11 is also bowed as best seen in FIGS. 1 and 2 wherein the ends 16 and 17 of the handle and brush head respectively are essentially in the same plane in a bottom view and the portion between the two ends is concave in shape. The reason for the bowed shaped handle will be more fully described below in conjunction with the description of the brush head.

The bristles 13 of brush head 12, as best seen in FIG. 4, are curved away from a longitudinal axis through the handle and brush head in the direction of the arrow shown in FIG. 4, in a smooth continuous fashion with the bristles near the front of the toothbrush 17, distant from the handle end 16, displaced a greater distance than the bristles near the back end of the toothbrush near the handle. For sake of clarity and for the purpose of providing a complete description of the invention, the degree of curvature of the bristles is indicated by reference numeral 18 in FIG. 4.

In use, the user grasps the handle in the usual manner with the thumb and another finger in the natural depressions formed by the twisting of the handle about its longitudinal axis. Upon brushing, and due to the unique twisting of the handle, the bowing of the handle, and the curvature of the brush head bristles, the bristles will be caused to make maximum and direct contact with the surface of the teeth and, simultaneously, the bristles near the front of the toothbrush head will be caused to contact and concentrate on the gum line.

Thus, what has been described, is a unique toothbrush comprising a curved bristle head, a handle twisted about its longitudinal axis and wherein the handle is also bowed all allowing for simultaneous brushing of the teeth and massaging of the gum line.

It is to be understood that the invention is not to be restricted to the parts as shown but that they may be widely varied within the invention as claimed.

What is claimed is:

1. A toothbrush comprising a handle and brush head having bristles extending therefrom wherein said bristles are curved away from a longitudinal axis through said handle and said brush head, with the bristles near the front of the toothbrush distant from the handle end displaced a greater distance from the longitudinal axis then the bristles near the back end of the toothbrush near the handle.

2. The toothbrush of claim 1 wherein said handle is twisted about said longitudinal axis through said handle and said brush head and in a direction opposite of the curve of said bristles.

3. The toothbrush of claim 1 wherein said handle is bowed.

4. The toothbrush of claim 2 wherein said handle is bowed.

* * * * *